US012643735B2

(12) United States Patent
McAtarian et al.

(10) Patent No.: US 12,643,735 B2
(45) Date of Patent: Jun. 2, 2026

(54) EQUIPMENT TRANSPORT BAG WITH DIRECT EQUIPMENT LIFTING CONNECTION

(71) Applicant: Andax Industries, L.L.C., Saint Marys, KS (US)

(72) Inventors: Patrick F. McAtarian, Saint Marys, KS (US); Mark McAtarian, Saint Marys, KS (US)

(73) Assignee: Andax Industries, L.L.C., Saint Marys, KS (US)

( * ) Notice: Subject to any disclaimer, the term of this patent is extended or adjusted under 35 U.S.C. 154(b) by 29 days.

(21) Appl. No.: 18/665,033

(22) Filed: May 15, 2024

(65) Prior Publication Data

US 2025/0353665 A1 Nov. 20, 2025

(51) Int. Cl.
*B65D 88/16* (2006.01)
*B65D 90/00* (2006.01)

(52) U.S. Cl.
CPC ..... *B65D 90/0033* (2013.01); *B65D 88/16* (2013.01)

(58) Field of Classification Search
CPC ..... B65D 90/0033; B65D 90/24; B65D 88/1675; B65D 88/1681; B65D 88/1687; B65D 33/06; B65D 33/065; B65D 33/08; B65D 33/14
USPC .... 150/154, 157, 161, 164, 165, 901; 383/6, 383/7, 9, 10, 17, 18, 19
See application file for complete search history.

(56) References Cited

U.S. PATENT DOCUMENTS

| | | | | |
|---|---|---|---|---|
| 809,142 | A * | 1/1906 | Schutz | B65D 33/14 425/813 |
| 8,777,001 | B1 * | 7/2014 | Bennett | B65D 85/00 206/204 |
| 9,487,331 | B2 | 11/2016 | Bennett | |
| 10,259,634 | B2 | 4/2019 | Bennett | |
| 10,266,307 | B1 | 4/2019 | Mcatarian et al. | |
| 11,358,753 | B2 | 6/2022 | Mcatarian et al. | |
| 11,702,249 | B2 | 7/2023 | Mcatarian et al. | |
| 2020/0010247 | A1 | 1/2020 | Mcatarian et al. | |
| 2021/0024254 | A1 * | 1/2021 | McAtarian | B65D 33/1616 |
| 2023/0339656 | A1 | 10/2023 | Mcatarian et al. | |
| 2024/0109690 | A1 | 4/2024 | Mcatarian et al. | |

OTHER PUBLICATIONS

ABG Bag, Inc. 2022 Products (www.rexelutility.ca) (printed Dec. 9, 2024).

* cited by examiner

*Primary Examiner* — Nathan J Newhouse
*Assistant Examiner* — Nina K Attel
(74) *Attorney, Agent, or Firm* — Hovey Williams LLP

(57) ABSTRACT

An equipment transport bag assembly is operable to handle equipment having a lifting element. The bag assembly includes a bag and an equipment-handling assembly. The bag defines an interior configured to at least in part receive the equipment therein. The equipment-handling assembly includes a strap unit. The strap unit includes a strap attached relative to the bag. The strap defines a strap opening configured to receive the lifting element. The bag defines a bag opening configured to receive the lifting element. The strap opening and the bag opening are at least in part aligned relative to one another to facilitate contemporaneous extension of the lifting element through the strap and the bag.

18 Claims, 6 Drawing Sheets

EQUIPMENT TRANSPORT BAG WITH DIRECT EQUIPMENT LIFTING CONNECTION

BACKGROUND OF THE INVENTION

1. Field of the Invention

The present invention relates generally to equipment containment bag assemblies, also referred to herein as equipment transport bags, designed to provide environmentally safe shipping and storage conditions for leaking or otherwise non-performing equipment, such as pole-mounted distribution transformers, switchgear, breakers, and reclosers, equipped with one or more lifting appendages or elements (e.g., lifting lugs, eyes, or hooks).

2. Discussion of the Prior Art

Conventional electrical transformers used in power distribution systems include a sealed, oil-filled tank with internal electrical components, such as transformer coils. These transformers also have external hardware, such as mounting equipment, connection busses, and lifting lugs. These transformers are subject to leaking over time, resulting from damage to the transformer tank or from extended use. Such leakages can be environmentally damaging, inasmuch as the oil formulations within the transformers can often include hazardous chemicals (e.g., PCBs). It is therefore necessary to safely transport failed transformers for disposal or repair, in accordance with governmental regulations. In like manner, other types of equipment, and especially electrical utility equipment, require safe and effective containment and shipping enclosures.

Prior art equipment transport bags conventionally comprise puncture-proof and leak-resistant materials and include lifting loops or hoops to be engaged by lifting equipment. Due to the heavy nature of the equipment disposed therein, stress placed on the lifting loops may be substantial, with such stress carried over to other portions of the bag assemblies as well.

SUMMARY

According to one aspect of the present invention, an equipment transport bag assembly is provided. The bag assembly is operable to handle equipment having a lifting element. The bag assembly includes a bag and an equipment-handling assembly. The bag defines an interior configured to at least in part receive the equipment therein. The equipment-handling assembly includes a strap unit. The strap unit includes a strap attached relative to the bag. The strap defines a strap opening configured to receive the lifting element. The bag defines a bag opening configured to receive the lifting element. The strap opening and the bag opening are at least in part aligned relative to one another to facilitate contemporaneous extension of the lifting element through the strap and the bag.

Among other things, the inventive features described above facilitate transportation of electrical transformers and other equipment having a lifting appendage or element, while restricting egress of contaminants therefrom into the environment outside the bag assembly. These features also facilitate such transport without significant loads being applied to the bag itself, with substantial loads being at least primarily limited to the equipment-handling assembly.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 3:
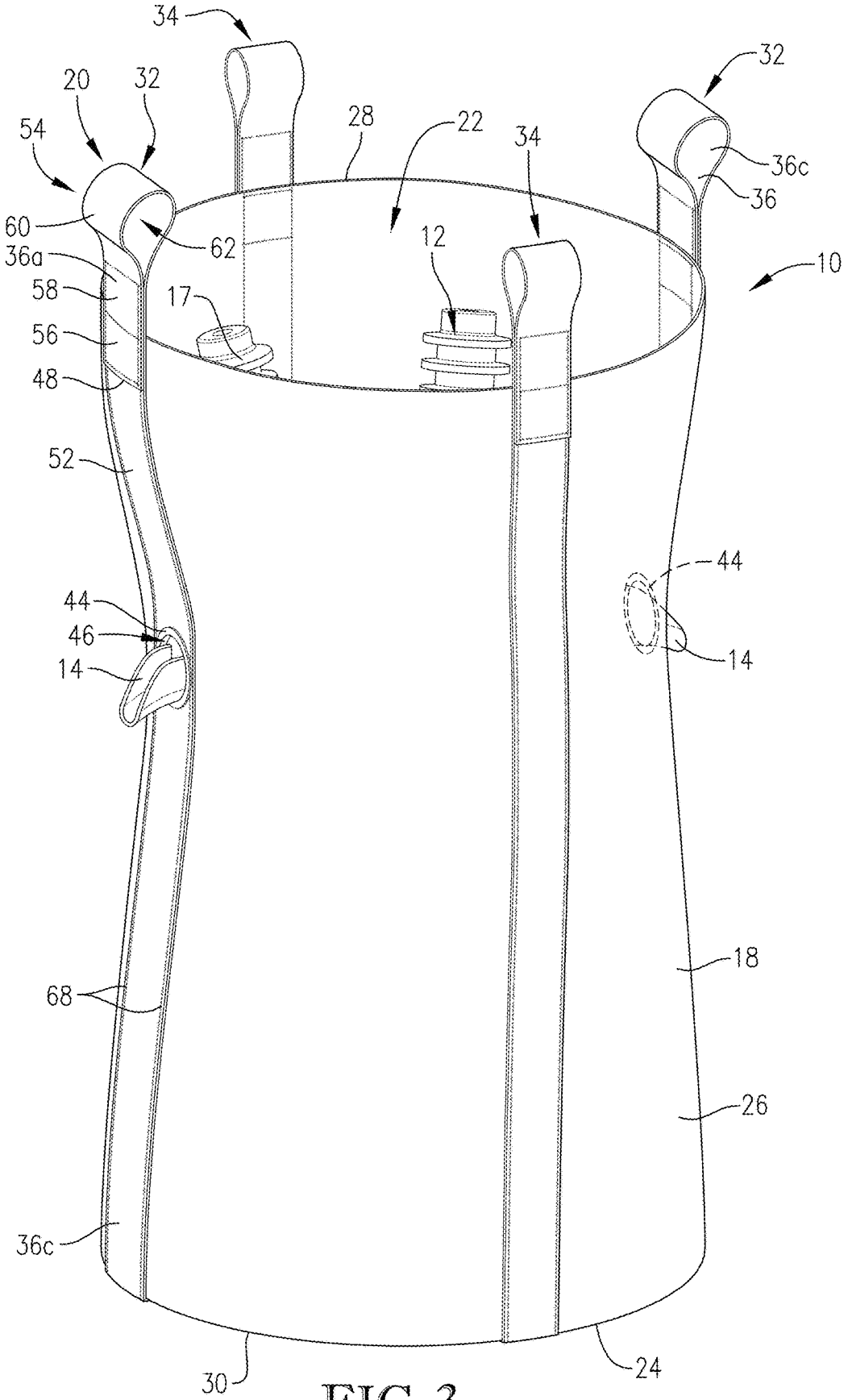
FIG. 3 is a front perspective view of the transformer and bag assembly of FIGS. 1 and 2 with the bag assembly in the fully expanded state and with the transformer lugs received in the lug openings of the bag assembly.
Figure 4:
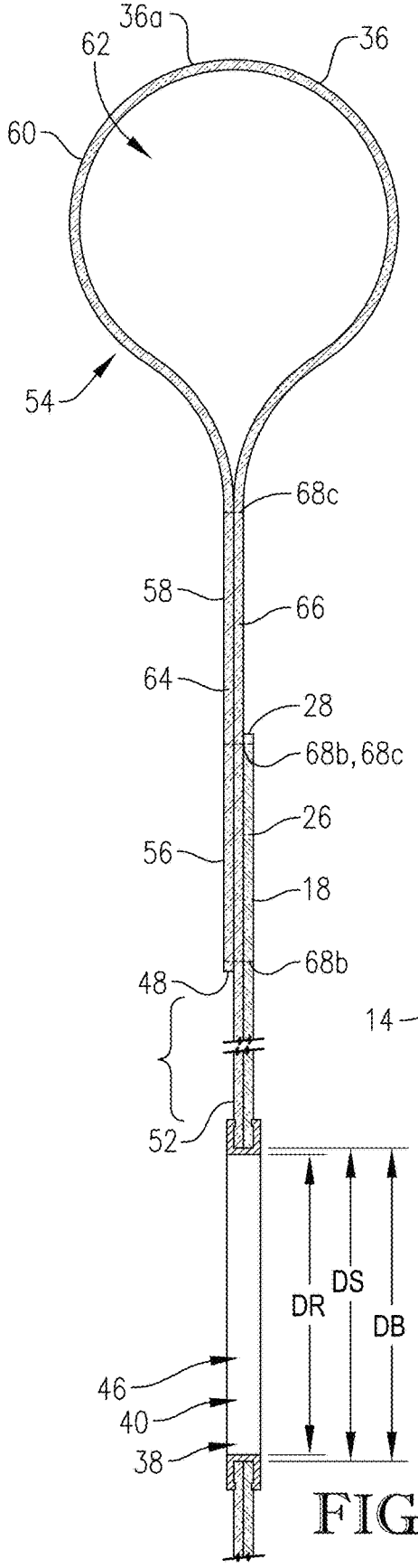
FIG. 4 is an enlarged cross-sectional side view of a strap and bag sidewall of the bag assembly of FIGS. 1-3, particularly illustrating the strap and sidewall layers and the lug opening area defined thereby.
Figure 5:
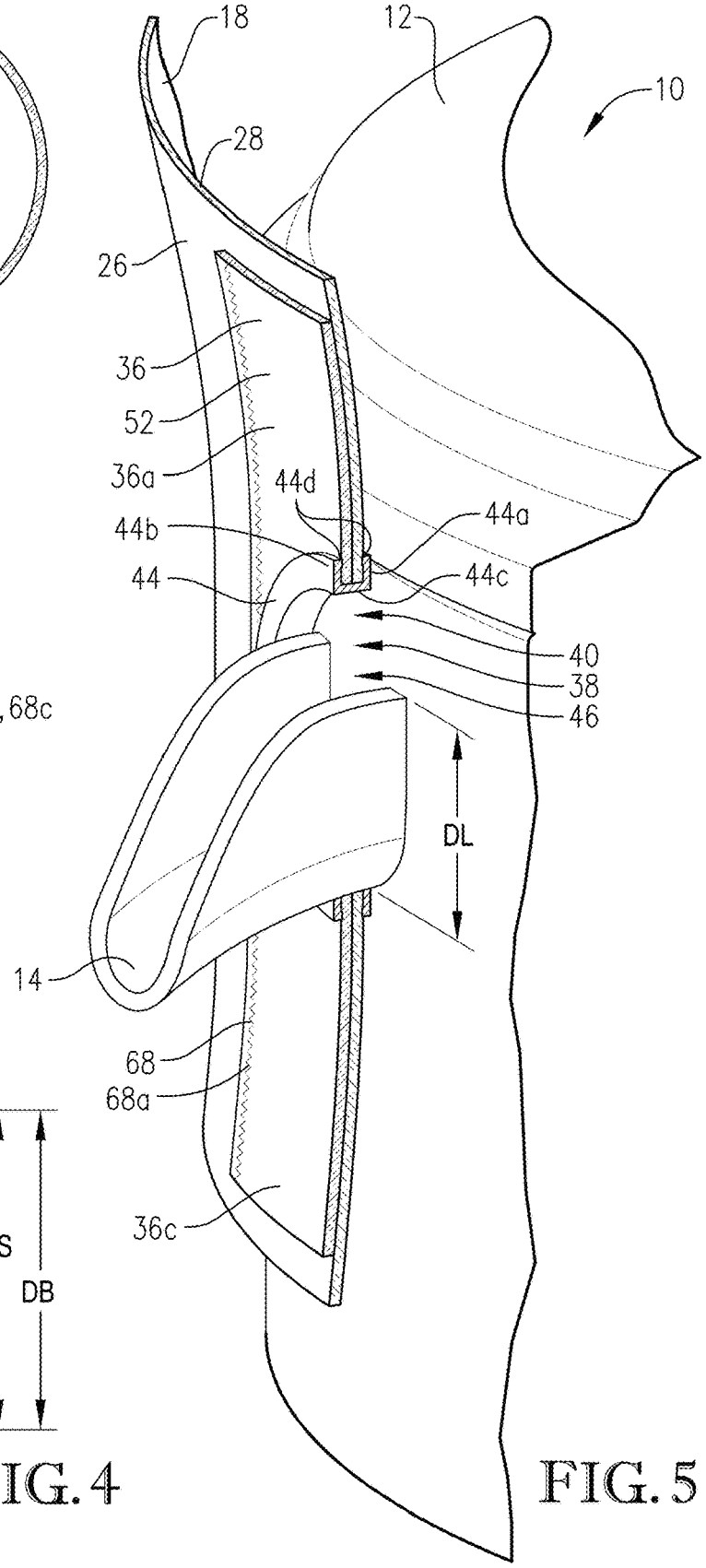
FIG. 5 is an enlarged, partially sectioned fragmentary perspective view of the transformer and bag assembly of FIGS. 1-3 in the fully expanded and engaged state of FIG. 3, with the illustrated transformer lug being received in the corresponding lug opening.
Figure 6:
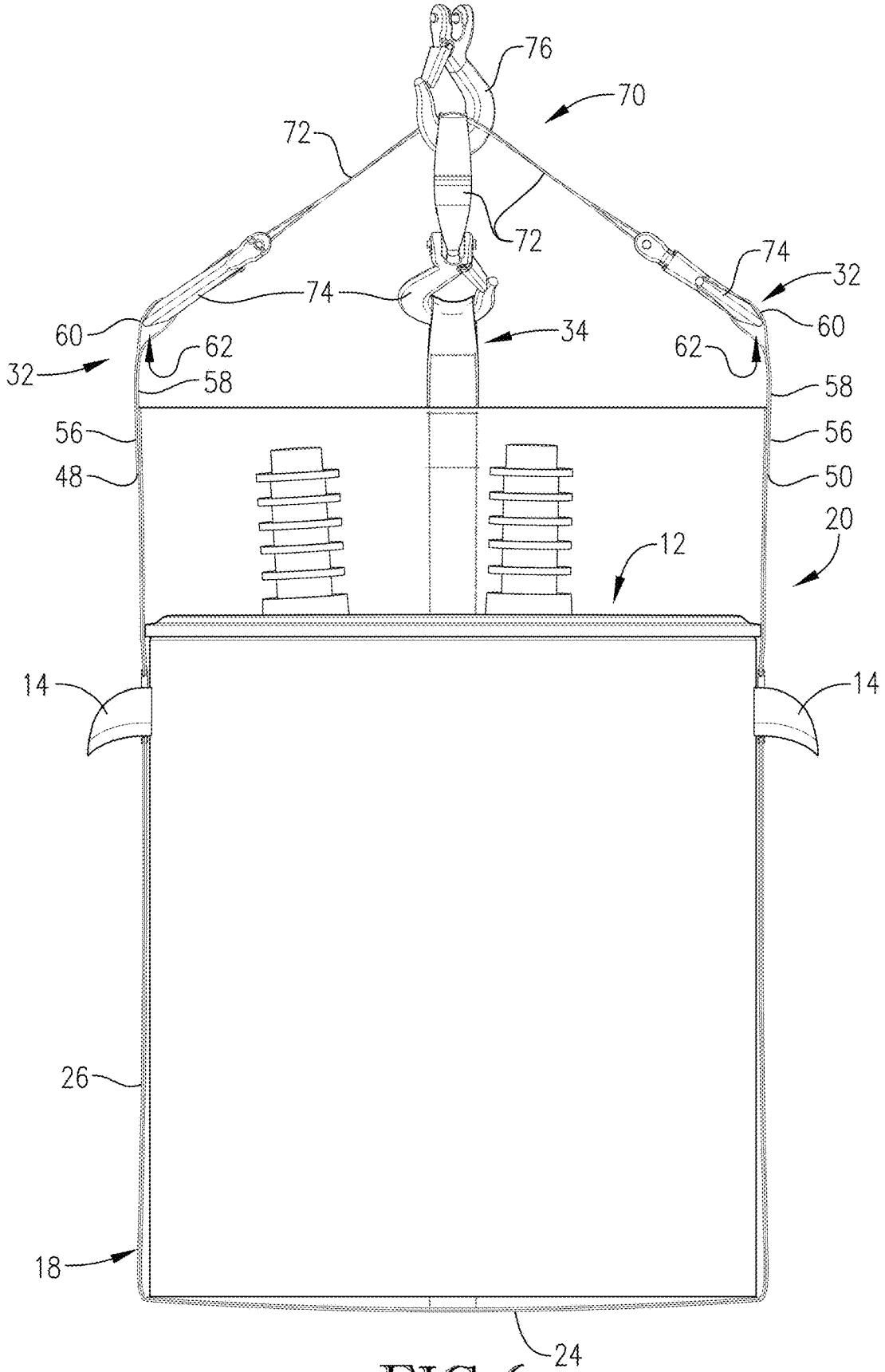
Figure 7:
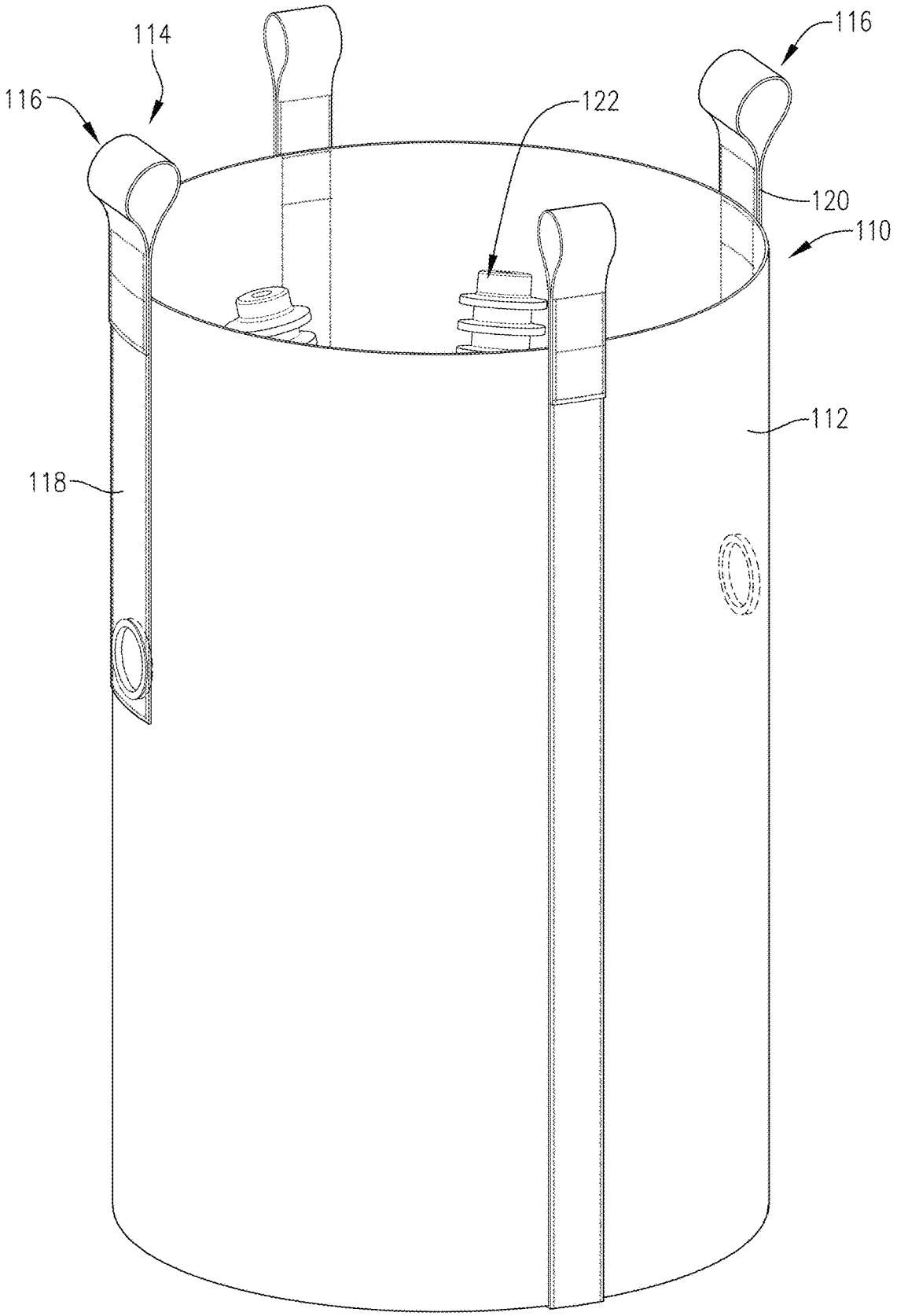

FIG. 6 is a sectional front view of the transformer and bag assembly of FIGS. 1-5 in the fully expanded and engaged state of FIGS. 3 and 5, with a lift assembly secured to the bag assembly to lift the bag assembly and the transformer; and FIG. 7 is a front perspective view of a transformer received in an equipment transport bag assembly in accordance with a second preferred embodiment of the present invention, wherein the bag assembly is in a fully expanded state.

The drawing figures do not limit the present invention to the specific embodiments disclosed and described herein. While the drawings do not necessarily provide exact dimensions or tolerances for the illustrated structures or components, the drawings are to scale with respect to the relationships between the components of the structures illustrated in the drawings.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Furthermore, unless specified or made clear, the directional references made herein with regard to the present invention and/or associated components (e.g., top, bottom, upper, lower, inner, outer, etc.) are used solely for the sake of convenience and should be understood only in relation to each other. For instance, a component might in practice be oriented such that faces referred to as "top" and "bottom" are sideways, angled, inverted, etc. relative to the chosen frame of reference.

Turning now to FIGS. 1-6, an equipment transport bag assembly 10 and an electrical transformer 12 are illustrated in accordance with a first preferred embodiment of the present invention. As will be discussed in greater detail below, the equipment transport bag assembly 10 is operable to handle equipment 12 having a lifting element 14, including but not limited to equipment such as the illustrated transformer 12. That is, configuration for use with other equipment types (i.e., with non-transformers, including but not limited to switchgear, breakers, and reclosers) is permissible.

The transformer 12 includes a main body 16; a plurality of bushings 17 extending generally axially upwardly from the main body 16; and a pair of diametrically opposed, side-mounted lifting elements or lugs 14 extending general radially outwardly from the main body 16. It is noted that such a lug configuration is a standard feature of most conventional transformers, such that the illustrated transformer 12 might be replaced by any of numerous alternate transformers known in the art without affecting the operability of the inventive bag assembly 10. That is, regardless of other features of a given transformer, the presence of diametrically opposed, radially outwardly extending lugs similar to those of the illustrated transformer 12 is likely. Alternatively stated, similar lugs may be understood to be a universal or near-universal feature of relevant transformers.

It is permissible according to some aspects of the present invention, however, for adaptations to the bag assembly to be made to accommodate storage and/or transport of transformers having non-standard lug or lifting element configurations (e.g., three or more equally spaced apart lugs, multiple axial heights of lugs, irregularly spaced lugs, variously sized lugs, alternative lifting elements such as eye bolts or other elements, and so on).

In a preferred embodiment, the bag assembly 10 broadly includes a bag 18 and an equipment-handling assembly 20. The bag 18 defines an interior 22 configured to at least in part receive the transformer 12 (or alternative equipment). The bag 18 includes a base or bottom wall 24 and a sidewall 26 extending upwardly from the base 24 to present a terminal upper margin 28 of the bag 18 and, in turn, of the sidewall 26 itself. A lower margin 30 of the sidewall 26 is defined adjacent the base 24. The base 24 and the sidewall 26 preferably cooperatively at least substantially define the aforementioned interior 22.

The base 24 is preferably circular in shape, with the sidewall 26 in turn being at least substantially cylindrical. Various bag shapes fall within the scope of some aspects of the present invention, however.

The bag 18 is preferably fabricated from a heavy-duty synthetic resin material to be puncture-resistant and at least substantially leak-proof (with regard to liquids that may be spilled from a transformer, for instance). Use of alternative materials falls within the scope of some aspects of the present invention, however, provided such materials are able to contain any spillage of liquid from the transformer 12 (or other structure) therein.

Figure 1:
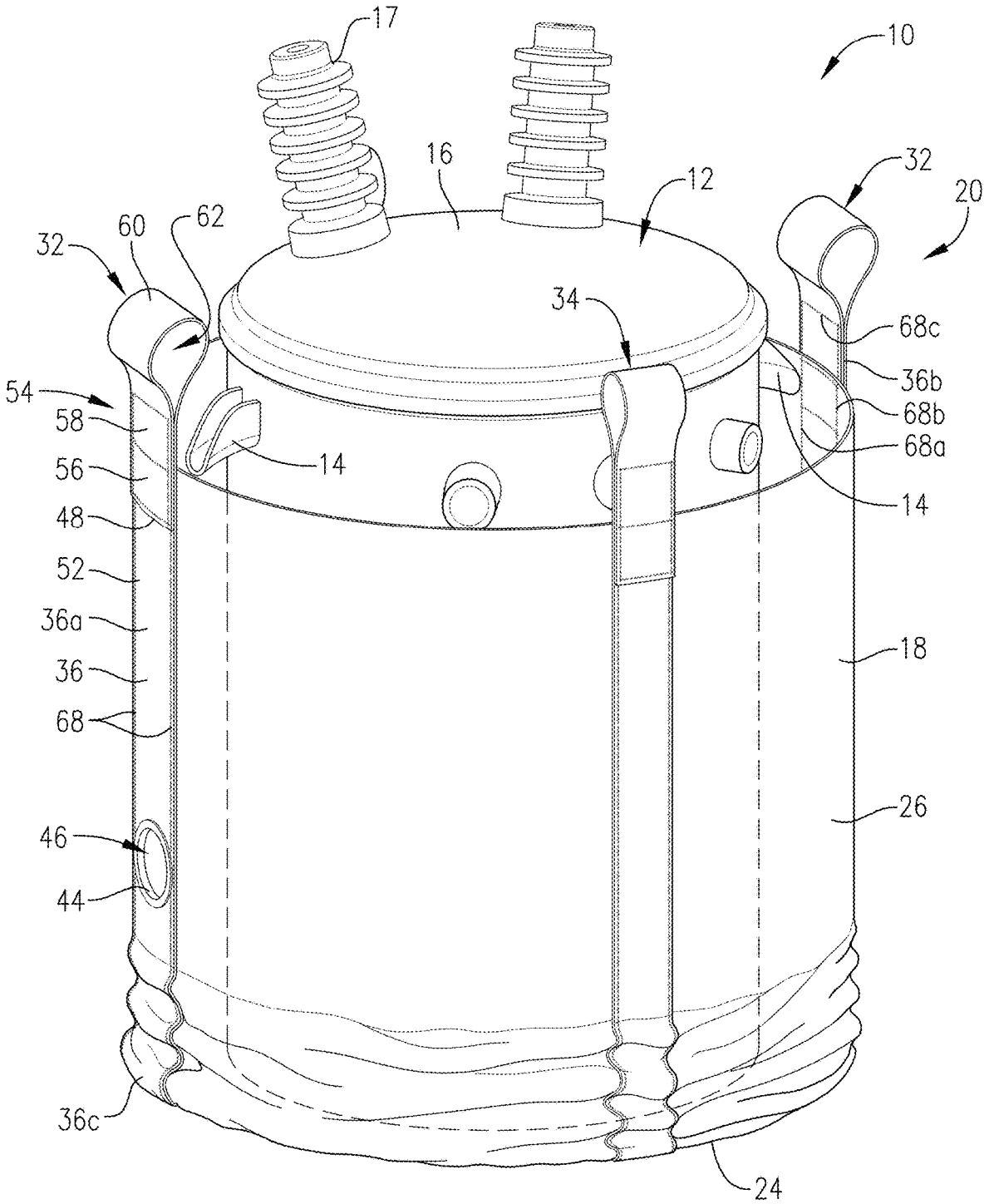
FIG. 1 is a front perspective view of a transformer received in an equipment transport bag assembly in accordance with a preferred embodiment of the present invention, wherein the bag assembly is in an intermediate, partially expanded and partially contracted state.
Figure 2:
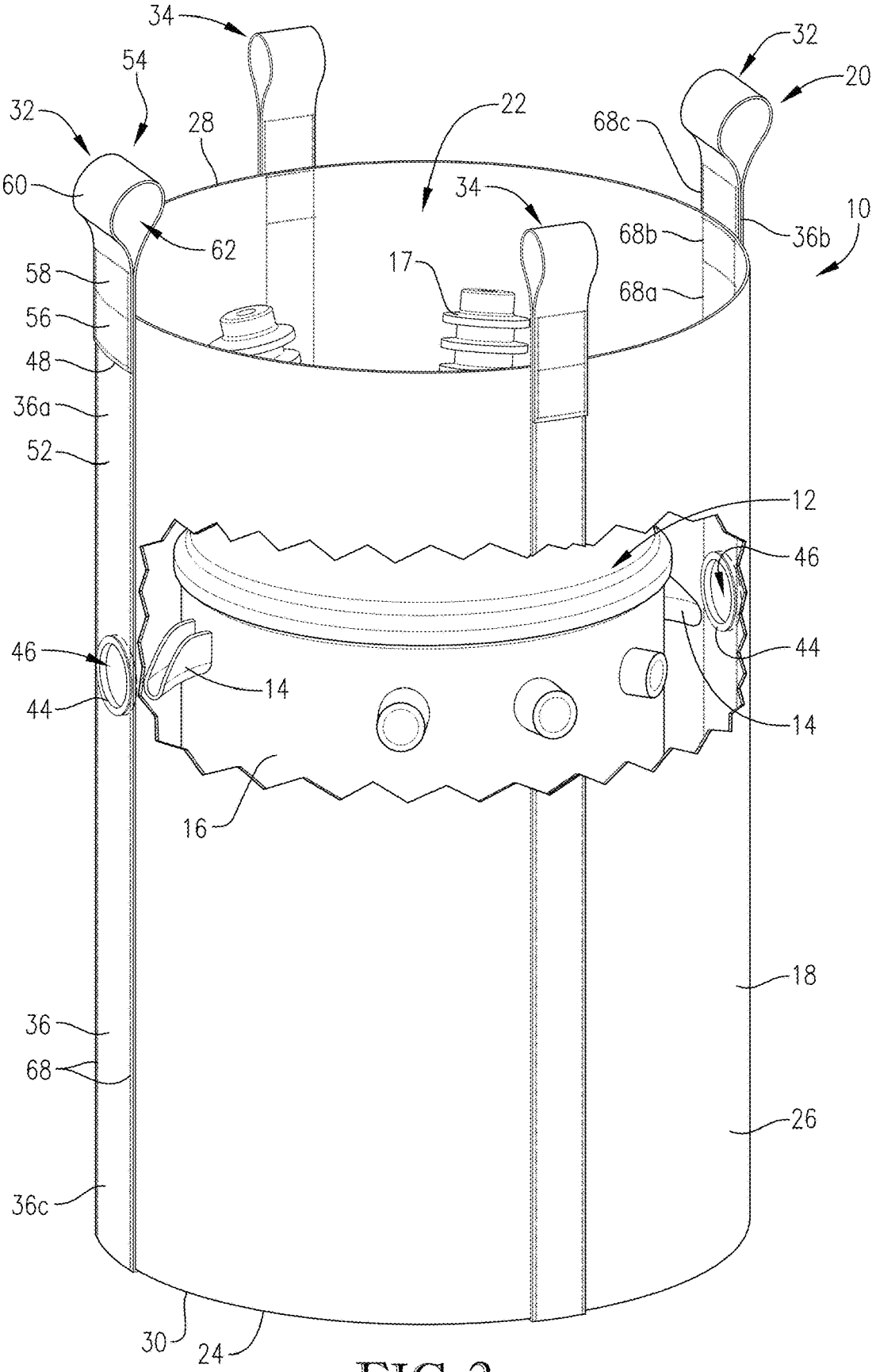
FIG. 2 is a partially sectioned front perspective view of the transformer and bag assembly of FIG. 1, with the bag assembly in a fully expanded state but not yet engaging the transformer lugs.

The material of the bag 18 is also preferably sufficiently flexible to facilitate manipulation of the bag as it is drawn up around the transformer 12. In a preferred method of use, for instance, the bag assembly 10 is initially provided in a fully collapsed or contracted state (not shown), in which the sidewall 26 is collapsed, contracted, or folded on itself so as to present a comparatively small axial height. This eases the placement of the transformer 12 onto the base 24, as the sidewall 26 provides minimal obstruction to movements of the transformer 12 and any associated lifting equipment, operators, etc. The bag 18 is then gradually expanded via upward force applied to the sidewall 26, which extends circumferentially around (i.e., outside) the main body 16 and, eventually, the lugs 14 of the transformer 12. The bag 18 is understood to be in an intermediate state when in this partially expanded, partially contracted state. One such intermediate state is illustrated in FIG. 1.

When the sidewall 26 has been urged upward to its fullest extent, as shown in FIGS. 2-6, the bag 18 is in its fully expanded configuration; and it is preferred that the entirety of the main body 16 of transformer 12 is disposed within the bag interior 22. (In the illustrated embodiment, the interior 22 extends axially upwardly to an upper boundary associated with the aforementioned upper margin 28 of the bag 18.)

The bag 18 is preferably additionally capable of containing any extensions of the transformer 12 from the main body 16, including but not limited to the illustrated bushings 17 and lugs 14. For instance, the transformer 12 could include one or more additional bushings, circuit breakers, ground straps, ground connectors, hanger brackets, oil fill plugs, fuses, tap changers, nameplates, and so on extending outwardly from or relative to the main body.

As will be discussed in greater detail below, however, containment of the lugs 14 is preferably optional or selective. That is, in some circumstances, such as those associated with lifting and/or transport it is preferred that the lugs 14 are in whole or in part disposed outside the bag interior 22 for purposes of accessibility. Thus, the bag assembly 10 and the transformer 12 are preferably positionable and/or configurable to selectively achieve either containment or exposure of the lugs 14.

The assembly 10 further preferably includes a pair of opposed, load-bearing strap units 32 and a pair of opposed, non-load-bearing strap units 34. The load-bearing strap units 32 and the non-load-bearing strap units 34 are preferably alternately arranged with one another and are most preferably spaced apart by right angles, although other arrangements fall within the scope of some aspects of the present invention. More or fewer strap units of both types may also be provided, and/or non-load-bearing strap units may be omitted entirely.

In a broad sense, each load-bearing strap unit 32 preferably includes a strap 36 attached relative to the bag 18. In the illustrated embodiment of FIGS. 1-6, only a single strap 36 is included, with the first and second load-bearing strap units 32 at least substantially being unitarily formed by the strap 36. More specifically, the load-bearing strap units 32 are respectively formed by first and second portions **36*a* and 36*b* of the strap 36**.

Preferably, the strap 36 defines a strap opening 38 in association with each of the load-bearing strap units 32, with the two (2) strap openings 38 each being configured to receive a corresponding one of the lifting elements 14.

Similarly, the bag 18 preferably defines a pair of bag openings 40 configured to receive respective ones of the lifting elements 14 and disposed to facilitate coordination with the strap openings 38. That is, the bag 18 is preferably configurable such that corresponding ones of the strap openings 38 and the bag openings 40 are at least in part aligned relative to one another to facilitate contemporaneous extension of the corresponding lifting elements 14 through the strap 36 and the bag 18.

More particularly, the strap openings 38 and the bag openings 40 are preferably at least in part aligned with each other when the bag 18 is in the aforementioned expanded configuration.

Even more preferably, and as will be discussed in greater detail below, the strap 36 and the bag 18 are secured to each other adjacent the strap and bag openings 38 and 40 in such a manner that the corresponding strap and bag openings 38 and 40 are continuously maintained in at least partial alignment with each other (including in and during transitions between the collapsed, intermediate, and expanded configurations of the bag 18).

In greater detail still, the strap 36 is preferably secured to the bag 18 in overlying engagement therewith at the corresponding pairs of strap and bag openings 38 and 40.

It is also noted that, although only partial alignment between corresponding strap and bag openings 38 and 40 is required, provided such alignment is sufficient to facilitate contemporaneous extension therethrough by the corresponding lifting element 14, it is most preferably that the strap and bag openings 38 and 40 be at least substantially congruent (i.e., same sized and same shaped) and continuously maintained in at least substantial alignment with each other. That is, it is most preferred that the strap and bag openings 38 and 40 cooperatively form a single, constant cross-section aperture 42 therethrough.

Most preferably, a strap opening dimension DS and a bag opening dimension DB are at least substantially equal to each other and to a cross-sectional lifting element dimension DL. That is, it is most preferable that the strap and bag openings 38 and 40 are sized and shaped at least generally similarly (i.e., only slightly larger) to the correspondingly positioned cross-sectional size and shape of the lifting element 14 when received therein, so that extension of the corresponding lifting element therethrough is unobstructed but not overly loose or "sloppy." Comparable sizing and shaping is preferred to minimize the possibility of contaminant egress through the strap and bag openings 38 and 40. It is noted that even more of a tight fit is also permissible, should egress through such openings be deemed a significant threat or problem.

A reinforcing element 44 is preferably provided within each aperture 42 and is configured to receive a load transmitted by the corresponding lifting element 14 extending therethrough. In the illustrated embodiment, the reinforcing elements 44 are in the form of eyelets or rings 44 (e.g., metal rings or hard plastic rings), although other forms of reinforcement might additionally or alternatively be provided. For instance, a reinforcing element could be comprise carefully placed and configured stitches of thread designed to strengthen the strap and bag at the aperture, or a penetrating liquid strengthener could be applied to the strap and/or bag at the aperture. Heat treatments (e.g., to melt adjacent portions of the strap and/or bag), application of molded material, and so on are also permissible. The reinforcing element may also in some embodiments be omitted entirely.

In the illustrated embodiment, the rings 44 each extend through the corresponding strap and bag openings 38 and 40 (i.e., through the jointly formed apertures 42) and are secured to each of the bag 18 and the strap 36. More particularly, each ring 44 in the preferred embodiment of FIGS. 1-6 preferably includes an inner wall 44*a*, an outer wall 44*b*, and a base wall 44*c* extending between and interconnecting the inner and outer walls 44*a* and 44*b* to present a generally U-shaped cross-sectional profile. As best shown in FIGS. 4 and 5, the bag 18 (more particularly, the sidewall 26 thereof) and the strap 36 are in part disposed between the inner and outer walls 44*a* and 44*b* and circumscribe the base wall 44*c*. The ring 44 preferably includes lips 44*d* that project into corresponding ones of the sidewall 26 and strap 36 to squeeze and secure the ring 44 thereonto.

The base wall 44*c* defines a lug opening or ring opening 46 through which the corresponding lug 14 may extend. The ring opening presents a ring opening dimension DR that is at least substantially similar (more specifically, only slightly smaller) than the previously described bag opening and strap opening dimensions DB and DS. The lug or ring opening dimension DR is thus likewise at least substantially similar to (and, more specifically, only slightly larger than) the lifting element dimension DL.

In the illustrated embodiment, the rings 44 do not have a substantial impact on the size of the aperture 42, with the aperture 42 and the ring opening 46 being similarly sized. However, if reinforcing elements having a significant impact on the aperture size are used, it is noted that sizing adjustments may be necessary to ensure the overall similarity between the sizing of the lifting elements and the reinforcing elements.

Turning now to the strap 36 itself, as noted previously, the single, unitarily formed strap 36 preferably cooperatively at least substantially forms both of the load-bearing strap units 32. That is, the two (2) load-bearing strap units 32 are at least substantially unitarily formed by the (single) strap 36, with the strap 36 defining both of the strap openings 38 (and the bag sidewall 26 defining both of the corresponding bag openings 40), with each of the strap openings 38 being at least in part aligned with the corresponding one of the bag openings 40, as described in detail above.

More particularly, as noted previously, the strap 36 preferably includes the first portion 36*a* at least substantially forming a first one of the load-bearing strap units 32 and the second portion 36*b* at least substantially forming a second one of the load-bearing strap units 32. The strap 36 further preferably includes a third portion 36*c* extending between and connecting the first and second load-bearing strap units 32 (or, alternatively, the strap portions 36*a* and 36*b*). More particularly, the third portion 36*c* is preferably in the form of a bight 36*c* extending along the bag sidewall 26 from the first and second portions 36*a* and 36*b* and thereafter below the bag base 24.

Alternatively stated, in a preferred embodiment, the single strap 36 presents first and second ends 48 and 50 and includes the first portion 36*a* that at least substantially forms the first load-bearing strap unit 32, the bight 36*c*, and the second portion 36*b* that at least substantially forms the second load-bearing strap unit 32. Non-integral designs fall within the scope of some aspects of the present invention, however. For instance, the load-bearing strap units could alternatively be formed discretely from each other and interconnected by an intermediate bight or strap secured thereto, or the intermediate strap could be omitted entirely, with the load-bearing strap units thus being completely independent of each other except through connection to the bag itself.

For instance, in a second embodiment of the present invention illustrated in FIG. 7, a bag assembly 110 includes a bag 112 and an equipment-handling assembly 114 including a pair of discrete, separate load-bearing strap units 116 each at least substantially formed from a respective discrete, separate strap 118 or 120. Alternatively stated, a first one of the straps 118 at least substantially forms a first one of the strap units 116 and is entirely discrete from and separate from a second one of the straps 120 that forms a second one of the strap units 116, except through indirect connection to each other via the bag 112 itself, via equipment 122 housed in the bag 112, and/or via lifting equipment (not shown) that engages each of the strap units 116.

It is noted that, with certain exceptions as discussed in detail above, many of the elements of the bag assembly 110 of the second embodiment are the same as or very similar to those described in detail above and below in relation to the bag assembly 10 of the first embodiment. Therefore, for the sake of brevity and clarity, redundant descriptions and numbering have been generally avoided here. Unless otherwise specified, the detailed descriptions of the elements presented above and below with respect to the first embodiment should therefore be understood to apply at least generally to the second embodiment, as well.

Returning again to the first preferred embodiment of the present invention, as shown in FIGS. 1-6, the strap 36 integrally at least substantially forms a sidewall portion or leg 52 and a projecting portion 54 associated with each of the load-bearing strap units 32.

The sidewall portion 52 preferably extends along the bag sidewall 26 and defines the strap opening 38 (corresponding to the bag opening 40 formed in sidewall 26).

The projecting portion 54 is preferably continuously formed with the sidewall portion 52 (i.e., the sidewall portion 52 and the projecting portion 54 are integrally formed by the strap 36).

The projecting portion 54 preferably includes a securement portion 56 continuous with the sidewall portion 52 and at least in part overlying and secured to the sidewall 26, a neck portion 58 continuous with the securement portion 56 and extending at least substantially upwardly away from the upper margin 28 of the sidewall 26, and a loop portion or loop 60 extending from the neck portion 58 and defining a loop opening 62, such that the loop 60 is at least substantially adjacent the sidewall portion 52. That is, the loop 60 is spaced from the sidewall portion 52 only by the neck portion 58 at the base thereof and the securement portion 56 securing the loop 60 relative the sidewall 26.

It is permissible according to some aspects of the present invention to combine the neck and securement portions, such that the loop is defined immediately adjacent the upper margin of the sidewall rather than being spaced slightly therefrom.

It is also permissible according to some aspects of the present invention for the securement portion, neck, and/or loop to be shifted axially downward along the sidewall, with the loop perhaps even being disposed in whole or in part below the upper margin thereof.

It is noted that the loop 60 is most preferably connected to the bag 18 only via the securement portion 56 but is otherwise freely movable.

Furthermore, it is noted that the loop 60 is secured to the bag in such a manner as to be generally biased away from the interior 22. That is, the loop 60 is inclined toward an exterior disposition relative to the bag 18.

In the illustrated embodiment, and as best shown in FIG. 4, the neck portion 58 and the securement portion 56 each comprise two (2) overlapping layers 64 and 66 of the strap 36, with the layer 64 terminating at the strap end 48 for a first one of the load-bearing strap units 32 and at the strap end 50 for the other one of the load-bearing strap units 32.

The load-bearing strap units 32 (or, alternatively described, the strap 36) are preferably secured to the sidewall 26 via stitching 68, although other securement means, including but not limited to adhesives or glues, thermal bonding, riveting, and stapling are permissible according to some aspects of the present invention. In some embodiments, indirect attachment of at least portions of the strap units may occur. That is, attachment relative to the bag, rather than directly to the bag, may occur.

Preferably, stitching 68*a* is provided vertically along each side of the strap 36 to secure the sidewall portion 52 to the sidewall 26; in a generally rectangular form 68*b* to secure the overlapping layers 64 and 66 of the securement portion 56 to each other and to the bag sidewall 26; and in a generally table-like (or open bottom rectangular) form 68*c* to secure the overlapping layers 64 and 66 of the neck portion 58 to each other.

The stitching 68*a* thus preferably extends through a single layer of the strap 36 and the bag sidewall 26. As best shown in FIG. 4, the stitching 68*b* in contrast preferably extends through dual layers 64 and 66 of the strap 36, in addition to the bag sidewall 26. The stitching 68*c* overlaps with the stitching 68*c* at the interface between the securement portion 56 and the neck portion 58. Thus, a lowermost portion of the stitching 68*c* extends through the three (3) total layers 64, 66, and 26 (of the strap 36 and the bag sidewall 26), whereas the remaining stitching 68*c* preferably extends only through the two (2) layers 64 and 66 of the strap 36.

However, other stitching configurations suitable for withstanding and appropriately distributing any loads applied thereto fall within the scope of some aspects of the present invention.

It is noted that, although each load-bearing strap unit 32 is formed at least substantially from the strap 36, such requirement should not be understood to preclude the addition of hardware (such as D-rings, O-rings, or triangular rings, etc.) and other elements forming a relatively small part of the load-bearing strap unit as a whole. For instance, a metal ring could be threaded through a reduced-size loop, or the loop could be omitted in favor of a riveted-on ring. Furthermore, it is permissible according to some aspects of the present invention for formation of one or more of the load-bearing strap units to include substantial contributions from components exclusive of the strap itself. For instance, the strap unit could include multiple straps or be formed from a combination of one or more straps and rope, wire, etc., without departing from the scope of some aspects of the present invention.

As noted previously, the bag assembly 10 preferably additionally includes a pair of non-load-bearing strap units 34. The non-load-bearing strap units 34 are preferably generally configured similarly to the load-bearing strap units 32, except with the omission of any strap openings or associated reinforcing elements. Similarly, the bag 18 is preferably devoid of bag openings corresponding to the non-load-bearing strap units 34. It is noted that a variety of configurations of the non-load-bearing strap units fall within the scope of the present invention, with the most suitable designs assisting in positioning and control of the bag 18 relative to the equipment 12 therein while carrying minimal loads.

In order to effectively lift and transport the transformer 12 within the bag 18, a lift assembly 70 may be employed (FIG. 7) The illustrated lift assembly 70 includes a plurality of lifting straps 72 corresponding to the strap units 32 and 34, with each of the lifting straps 72 including a hook 74 configured to be received in a corresponding loop 60 (i.e., through the loop opening 62 defined thereby). A central hook 76 engages the plurality of lifting straps 72 and, upon upward motion (actuated by a further lifting element or operator not illustrated), is operable to lift the entire bag assembly 10 and the equipment or transformer 12 therein.

It is noted that alternative lift assemblies, mechanisms, and methods fall within the scope of the present invention.

As will be readily understood by those of ordinary skill in the art, the construction of the strap units 32 and 34 is such that, during lifting and manipulation of the bag assembly 10, the load-bearing strap units 32 and, in turn, the associated lift assembly 70, bear a substantial portion of the lifting load. In contrast, the non-load-bearing strap units 34 and the bag 18 itself bear only a minor portion of none of the lifting load.

Alternatively stated, the load-bearing strap units 32 (and the lift assembly 70) bear essentially all of the load of the equipment 12, while the bag 18 at least substantially bears only its own weight and that of any fluid or other contaminants from the equipment 12 collected therein.

In an exemplary method of use, the bag assembly 10 is initially placed in a collapsed configuration on the ground, on a floor, or on another suitable support surface. The transformer (or other equipment) 12 is then placed on the bag assembly 10 and, in particular, on the base or bottom wall 24 thereof. The sidewall 26 is pulled up (i.e., expanded) either manually or by other suitable means, such that the bag assembly 10 shifts into a partially collapsed, partially expanded configuration. Further upward lifting or pulling of the sidewall 26 to shift the bag assembly 10 into the fully expanded configuration preferably occurs, with the transformer or equipment 12 thereby being received in the bag interior 22. The transformer 12 and/or the bag assembly 10 may then be manipulated such that the lugs or lifting elements 14 of the transformer or equipment 12 extend through the corresponding strap and bag openings 38 and 40 (i.e., through the corresponding apertures 42). The lift assembly 70 is then used as described above to engage the strap units 32 and 34 and lift/manipulate the bag assembly 10, with the load-bearing strap units 32 and, in turn, the lift assembly 70, bearing at least substantially all of the lifting load associated with the transformer 12. In contrast, the bag 18 itself bears very little or none of the lifting load.

Features of one or more embodiments described above may be used in various combinations with each other and/or may be used independently of one another. For instance, although a single disclosed embodiment may include a preferred combination of features, it is within the scope of certain aspects of the present invention for the embodiment to include only one (1) or less than all of the disclosed features, unless the specification expressly states otherwise or as might be understood by one of ordinary skill in the art. Therefore, embodiments of the present invention are not necessarily limited to the combination(s) of features described above.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

Although the above description presents features of preferred embodiments of the present invention, other preferred embodiments may also be created in keeping with the principles of the invention. Furthermore, as noted previously, these other preferred embodiments may in some instances be realized through a combination of features compatible for use together despite having been presented independently as part of separate embodiments in the above description.

The inventors hereby state their intent to rely on the Doctrine of Equivalents to determine and access the reasonably fair scope of the present invention as pertains to any apparatus not materially departing from but outside the literal scope of the invention set forth in the following claims.

We claim:

1. An equipment transport bag assembly operable to handle equipment having a lifting element, said bag assembly comprising:

a bag defining an interior configured to at least in part receive the equipment therein; and an equipment-handling assembly including a strap unit, said strap unit including a strap attached relative to the bag, said strap defining a strap opening configured to receive the lifting element, said bag defining a bag opening configured to receive the lifting element, said strap opening and said bag opening being at least in part aligned relative to one another to facilitate contemporaneous extension of the lifting element through the strap and the bag, said bag including a bottom wall and a sidewall extending upwardly from the bottom wall, said strap including:

a sidewall portion extending along the bag sidewall and defining the strap opening, and a projecting portion forming a loop at least substantially adjacent the sidewall portion, said bag sidewall presenting upper and lower margins, said projecting portion of the strap including:

a securement portion at least in part overlying and secured to the sidewall, a neck portion continuous with the securement portion and extending at least substantially upwardly away from the upper margin of the sidewall, and a loop portion extending from the neck portion and defining the loop.

2. The bag assembly of claim 1, said bag being shiftable between a collapsed configuration and an expanded configuration, said strap opening and said bag opening being at least in part aligned with each other when the bag is in the expanded configuration.

3. The bag assembly of claim 2, said strap opening and said bag opening further being at least in part aligned with each other when the bag is in the collapsed configuration.

4. The bag assembly of claim 3, said strap and said bag being secured to each other adjacent the strap opening and the bag opening such that the strap opening and the bag opening are continuously maintained in at least partial alignment with each other.

5. The bag assembly of claim 4, said strap being attached to the bag in overlying engagement therewith at the strap opening and the bag opening.

6. The bag assembly of claim 5, said strap being attached to the bag via stitching.

7. The bag assembly of claim 1, said strap opening and said bag opening being at least substantially congruent.

8. The bag assembly of claim 7, said strap opening and said bag opening being continuously maintained in at least substantial alignment with each other.

9. The bag assembly of claim 1, said bag assembly further comprising a reinforcing element extending through at least one of said strap opening and said bag opening and configured to receive a load transmitted by said lifting element.

10. The bag assembly of claim 9, said reinforcing element comprising a ring.

11. The bag assembly of claim 10, said ring extending through said strap opening and said bag opening and being secured to each of said bag and said strap.

12. The bag assembly of claim 11, said ring including an inner wall, an outer wall, and a base wall extending between and interconnecting the inner and outer walls, said bag and said strap each being in part disposed between said inner and outer walls and circumscribing said base wall.

13. The bag assembly of claim 1, said strap opening having a strap opening dimension, said bag opening having a bag opening dimension, said dimensions configured to be at least substantially equal to a cross-sectional lifting element dimension.

14. The bag assembly of claim 1, said sidewall portion and said projecting portion being integrally formed by said strap.

15. The bag assembly of claim 1, said securement portion comprising two overlapping layers of said strap, one of said layers presenting a terminal end of the strap.

16. The bag assembly of claim 1, said bag opening being formed in the sidewall.

17. The bag assembly of claim 1, further comprising:

a second strap unit at least substantially similar to said strap unit.

18. The bag assembly of claim 17, said strap unit and said second strap unit at least substantially being unitarily formed by said strap, said strap defining a pair of said strap openings, said bag defining a pair of said bag openings, each of said strap openings being at least in part aligned relative to a corresponding one of said bag openings.

* * * * *